US007963239B2

(12) United States Patent
Ishii et al.

(10) Patent No.: US 7,963,239 B2
(45) Date of Patent: Jun. 21, 2011

(54) ZIGZAG SEWING MACHINE

(75) Inventors: Yasunori Ishii, Chofu (JP); Yasushi Suto, Chofu (JP)

(73) Assignee: Juki Corporation, Chofu-shi, Tokyo (JP)

( * ) Notice: Subject to any disclaimer, the term of this patent is extended or adjusted under 35 U.S.C. 154(b) by 515 days.

(21) Appl. No.: 12/194,090

(22) Filed: Aug. 19, 2008

(65) Prior Publication Data

US 2009/0050038 A1 Feb. 26, 2009

(30) Foreign Application Priority Data

Aug. 21, 2007 (JP) ..... 2007-214594

(51) Int. Cl.
*D05B 19/14* (2006.01)
*D05B 19/16* (2006.01)
*D05B 3/00* (2006.01)

(52) U.S. Cl. ..... 112/462; 112/157; 112/449

(58) Field of Classification Search ..... 112/154, 112/157, 447–464, 220, 221; 700/136–138
See application file for complete search history.

(56) References Cited

U.S. PATENT DOCUMENTS

| | | | | | |
|---|---|---|---|---|---|
| 4,284,016 | A | * | 8/1981 | Matumura | 112/458 |
| 4,441,439 | A | * | 4/1984 | Hanyu et al. | 112/458 |
| 4,572,095 | A | * | 2/1986 | Makabe et al. | 112/456 |
| 4,966,090 | A | * | 10/1990 | Tanaka et al. | 112/456 |
| 4,986,201 | A | * | 1/1991 | Hyodo et al. | 112/456 |
| 5,566,632 | A | * | 10/1996 | Nishizawa et al. | 112/470.03 |

FOREIGN PATENT DOCUMENTS

| | | |
|---|---|---|
| JP | 10-118363 | 5/1998 |
| JP | 10-146480 | 6/1998 |
| JP | 2004-329379 | 11/2004 |

* cited by examiner

*Primary Examiner* — Ismael Izaguirre
(74) *Attorney, Agent, or Firm* — Drinker Biddle & Reath LLP

(57) ABSTRACT

A zigzag sewing machine is provided. The zigzag sewing machine includes a stitching motor which moves a needle, a feeding motor which moves a feed dog to feed a cloth, a needle swinging motor which swings the needle, a multi-stage-operating portion operable to adjust at least one of a feed amount of the cloth and a swing amount of the needle in a minimum adjustable unit, and a control section which controls the stitching motor, the feeding motor and the needle swinging motor to carry out a zigzag sewing in accordance with the at least one of the feed amount and the swing amount adjusted by the multistage-operating portion. The control section is configured to selectively assign a first value and a second to the minimum adjustable unit depending on whether the stitching motor is in operation or not.

9 Claims, 3 Drawing Sheets

ZIGZAG SEWING MACHINE

CROSS-REFERENCE TO RELATED APPLICATION(S)

The present application claims priority from Japanese Patent Application No. 2007-214594 filed on Aug. 21, 2007, the entire content of which is incorporated herein by reference.

FIELD OF THE INVENTION

The present invention relates to a zigzag sewing machine which can form needle swing stitching patterns such as over-edge chainstitches, blind stitches and zigzag stitches.

DESCRIPTION OF RELATED ART

Zigzag sewing machines can form needle swing stitching patterns such as over-edge chainstitches, blind stitches and zigzag stitches.

A related art zigzag sewing machine includes a feeding mechanism, a feeding motor which drives the feeding mechanism, a needle, and a needle swinging motor which swings the needle in a swing width direction orthogonal to a feeding direction, and carries out such as over-edge chainstitching, blind stitching or zigzag stitching by controlling the respective motors in accordance with sewing data including a feeding pitch (a pitch of each stitch) and a needle swing width (see, e.g., JP 10-118363 A).

In order to allow a case-by-case adjustment of the sewing data, depending on a shape and dimensions of a portion to be sewn, a control section of this zigzag sewing machine changes the sewing data upon receipt of a signal output in response to an operator's operation to an adjusting means and then controls the feeding motor and the needle swinging motor.

As such adjusting means, there has been known an adjusting dial switch which is a multistage switch operable to perform multistage-adjustment in minimum adjustable units within a preset adjustable range. This adjusting dial switch is coupled to a control section including a memory serving as a storage portion and CPU or MPU serving as a computing portion, and the feeding pitch or the needle swing width can be adjusted in accordance with an operating position of the adjusting dial switch. For example, when the adjusting dial switch is operated by two stages, the feeding pitch or the needle swing width is adjusted by two times the minimum adjustable unit.

Setting ability, i.e. the number of adjustable stages, of the adjusting dial switch through one complete rotation is, for example, eight stages. Therefore, in order to largely change a value to be adjusted with such an adjusting dial switch, it has been necessary to turn the adjusting dial switch to exceed one complete rotation.

For example, in a case where an adjustable range of the feeding pitch through the adjusting dial switch is 0.0 mm to 5.0 mm, a minimum adjustable unit (an adjustable amount per one stage) is 0.2 mm, and the number of adjustable stages through one complete rotation of the adjusting dial switch is eight, the adjusting dial switch needs to be turned by more than three complete rotations in a maximum case.

During a sewing work with the stitching motor being driven, an operator looks at a cloth (a sewing portion) and manually handles the cloth near the up-and-down moving position of the needle. Therefore, when operating the adjusting dial switch during the sewing work, it is desirable for the operator to keep an eye on the cloth. However, when turning the adjusting dial switch by more than one complete rotation, the operator needs to release and hold the adjusting dial switch again, and at this moment, the operator often takes the eyes off the cloth. This situation gives the operator an uneasy feeling, and causes a risk of uneven stitches.

As for household sewing machines in particular, most operators are not so used to sewing machine operations. Thus, it is even more difficult to make precise adjustments.

SUMMARY OF THE INVENTION

It is an aspect of the present invention to improve operability of dial operations for adjusting a feeding pitch or a needle swing width even during a driving of a sewing machine.

According to an aspect of the present invention, a zigzag sewing machine includes: a needle; a stitching motor which moves the needle in a vertical direction; a feed dog disposed below the needle; a feeding motor which moves the feed dog to feed a cloth in a cloth feeding direction; a needle swinging motor which swings the needle in a direction intersecting the vertical direction and the cloth feeding direction; a multistage-operating portion operable to adjust at least one of a feed amount of the cloth and a swing amount of the needle in a minimum adjustable unit; and a control section which controls the stitching motor, the feeding motor and the needle swinging motor to carry out a zigzag sewing in accordance with the at least one of the feed amount and the swing amount adjusted by the multistage-operating portion. The control section is configured to assign a first value to the minimum adjustable unit when the stitching motor is not in operation and to assign a second value, which is different from the first value, to the minimum adjustable unit when the stitching motor is in operation.

Other aspects and advantages of the invention will be apparent from the following description, the drawings and the claims.

DETAILED DESCRIPTION

Hereinafter, an exemplary embodiment of the present invention will be described with reference to the drawings. The following exemplary embodiment does not limit the scope of the invention.

A zigzag sewing machine 1 according to the exemplary embodiment of the present invention is configured to form needle swing stitching patterns such as over-edge chainstitches, blind stitches and zigzag stitches.

Figure 1:
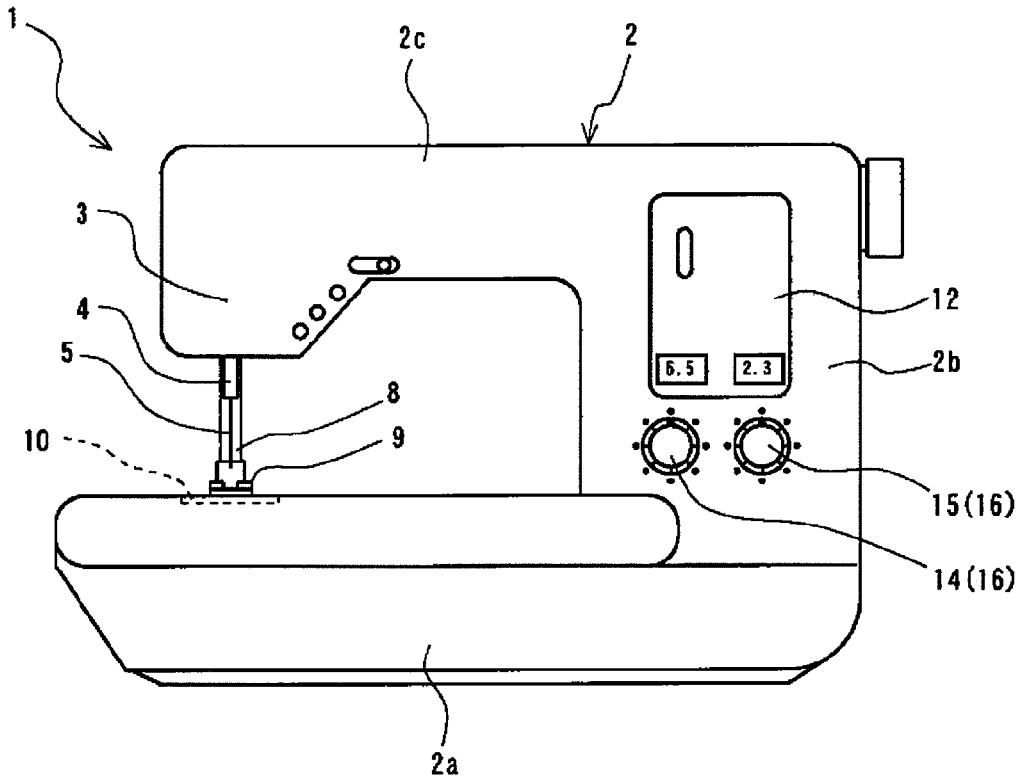
FIG. 1 is a schematic external view of a zigzag sewing machine according to an exemplary embodiment of the present invention.

As shown in FIG. 1, a machine frame 2 of the zigzag sewing machine 1 includes a bed portion 2*a* having a rectangular box shape, a coupling body portion 2*b* upwardly extending from a rear portion of the bed portion 2*a* which is on the right side in FIG. 1, and an arm portion 2*c* extending in parallel to the bed portion 2*a* from the upper portion of the coupling body portion 2*b* toward the front side which is the left side in FIG. 1.

A needle bar 4 is arranged on a free end portion 3 of the arm portion 2*c*, and a needle 5 is detachably attached to a lower end portion of the needle bar 4. A stitching mechanism and a swinging mechanism, which are not shown, are arranged inside the free end portion 3. The stitching mechanism moves the needle bar 4 in a vertical direction interlockingly with a rotation of a spindle (i.e., an upper shaft) which is driven by a stitching motor 6 shown in FIG. 2. The swinging mechanism swings the needle bar 4 along a swing width direction (i.e., right and left directions in FIG. 1) with a certain stroke by a driving force from a needle swinging motor 7 shown in FIG. 2.

A presser bar 8 is also arranged on the free end portion 3 on a downstream side of the needle bar 4 in a cloth feeding direction. The presser bar 8 supports a cloth presser 9 at the lower end thereof, and is biased by a biasing spring (not shown) which is disposed on an upper portion thereof such that the cloth presser 9 is pressed against a throat plate 10 disposed on an upper surface of the bed portion 2*a*.

A feed dog F is arranged below the throat plate 10, and is moved by a feeding mechanism interlockingly with the spindle such that the feed dog 8 partially protrudes out from the throat plate 10 below the cloth presser 9 and reciprocates back and forth along the cloth feeding direction. The feeding mechanism includes a feeding amount adjusting mechanism, for example, a feeding amount adjusting mechanism disclosed in JP 2004-329379 A. The feeding amount adjusting mechanism can change a feeding amount by a driving force from the feeding motor 11 shown in FIG. 2. The feeding motor 11 is arranged inside the machine frame 2.

Figure 2:
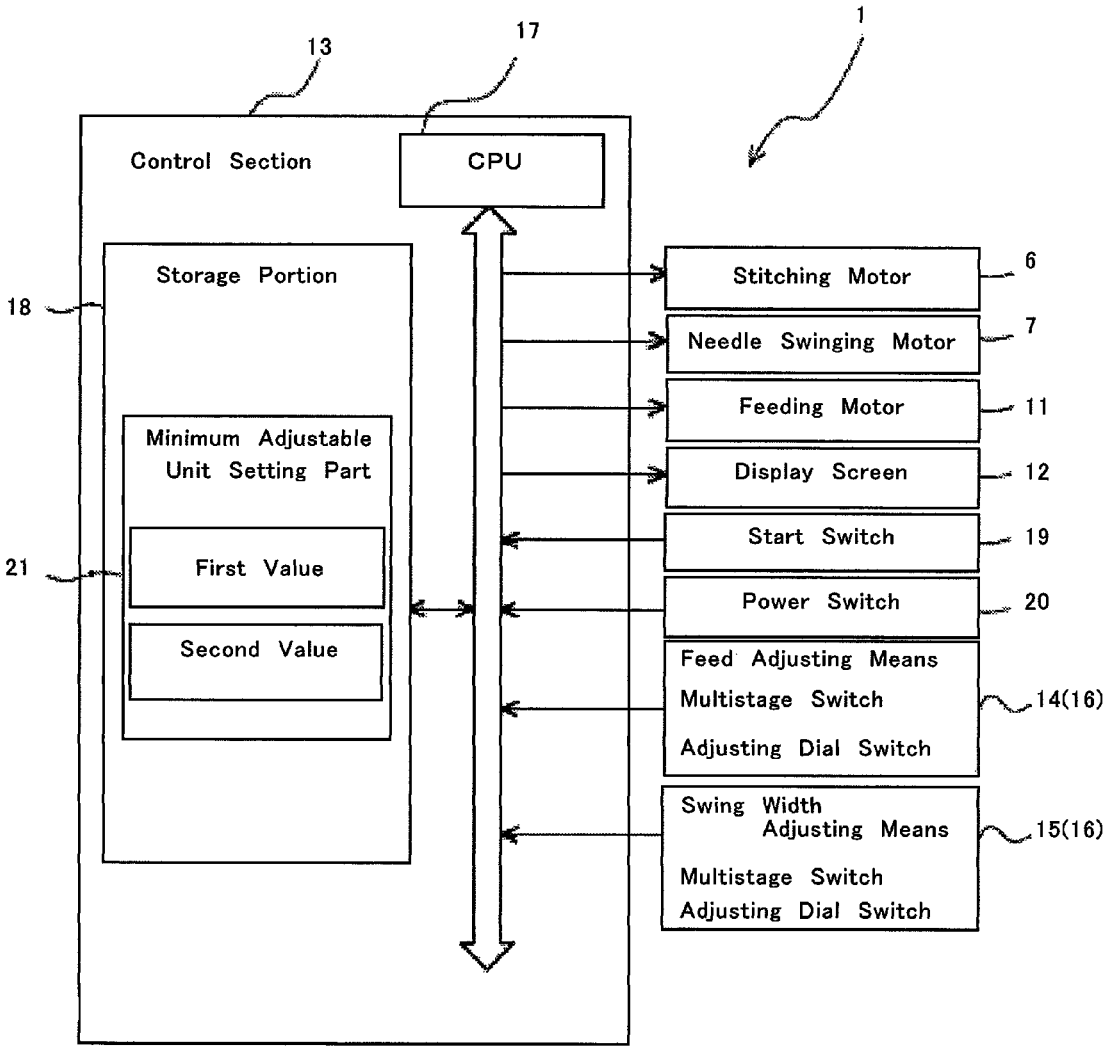
FIG. 2 is a block diagram of a configuration of the zigzag sewing machine.

On a near side (an operator side) of the coupling body portion 2*b* in FIG. 1, a display screen 12 is arranged. The display screen 12 may be a liquid crystal display panel, and is electrically coupled to a control section 13 as shown in FIG. 2 to display various information. The control section is arranged inside the machine frame 2, for example on a rear side of the display screen 12.

The display screen 12 may include a transparent touch panel. In such a case, an operating portion, from which necessary information are input, is provided on the display screen 12, for example by means of pictorial indication, in accordance with a design concept.

Below the display screen 12, a feed adjusting means 14 for adjusting a feeding pitch (a feeding amount) of a cloth is arranged on the left side, and a swing width adjusting means 15 for adjusting a swing width of the needle 5 is arranged on the right side.

The feed adjusting means 14 and the swing width adjusting means 15 are multistage switches through which multistage-adjustments can be made in minimum adjustable units within respective adjustable range. According to the exemplary embodiment, adjusting dial switches 16, which are rotatably operable, are used as the multistage switches. Each of the adjusting dial switches 16 includes a rotary switch, and is configured to generate a pulse at each unit of rotation angle. Further, a rotating direction of each of the adjusting dial switches 16 is detectable.

The adjusting dial switches 16 are electrically coupled to the control section 13. Setting ability, i.e. the number of adjustable stages of each of the adjusting dial switches 16 through one complete rotation is eight. Of course, the adjustment stages can be modified in accordance with the adjustable range or the design concept. Further, setting ability of one complete rotation may be different between the adjusting dial switch 16 used as the feed adjusting means 14 and the other adjusting dial switch 16 used as the swing width adjusting means 15.

Alternatively, the multistage switches may be push button switches. In such as case, it is preferable that each of the push button switches include an UP button for increasing the feeding pitch or the needle swing width and a DOWN button for reducing the feeding pitch or the needle swing width.

When a touch panel is being used, an input portion functioning as the push button switches may be displayed on the touch panel. However, when the push button switches are separately provided from the touch panel, it is advantageous in that erroneous operation to other input portions provided in the operation portion of the touch panel can be prevented.

While the feed adjusting means 14 and the swing width adjusting means 15 are both provided in the exemplary embodiment, the present invention can be applied in a case where only one of them is provided.

As shown in FIG. 2, the control section 13 controls operations of respective parts of the zigzag sewing machine 1, and includes CPU 17 (may be MPU) which functions as a computing part and a storage portion 18 (a memory).

According to the exemplary embodiment, the stitching motor 6 which drives the stitching mechanism, the needle swinging motor 7 which drives the swinging mechanism, the feeding motor 11 which drives the feeding amount adjusting mechanism, the display screen 12, the feed adjusting means 14, the swing width adjusting means 15, a start switch 19 which is used for starting and stopping a sewing operation, a power switch 20 which is used for supplying and stopping power, various operation switches such as a one-stitch sewing switch, and various sensors which are used for detecting various operations and positions, are electrically coupled to the control section 13, and the operations of the respective parts of the zigzag sewing machine 1 are controlled in accordance with control commands sent from the control section 13, specifically, the CPU 17.

The storage portion 18 includes ROM and RAM, each having appropriate amount of memory capacity, and an auxiliary storage device such as a removable memory card or a flash memory may also be used in combination when necessary in accordance with the design concept or the like.

The storage portion 18 includes a minimum adjustable unit setting part 21 in which a plurality of values assignable to the minimum adjustable unit is stored. In the exemplary embodiment, two values are stored for each of the minimum adjustable units for the feeding pitch adjustment and the needle swing width adjustment. However, the number of assignable values stored in the minimum adjustable unit setting part 21 is not particularly restricted. For example, two values may be stored for the adjustment of either one of the feeding pitch and the needle swing width while three or more values of may be stored for the adjustment of the other of the feeding pitch and the needle swing width. Further, in another example, three or more values may be stored for the adjustment of each of the feeding pitch and the needle swing width respectively.

In the exemplary embodiment, the two values assignable to the minimum adjustable unit are a first value and a second value which is greater than the first value. In other words, an amount of minimum adjustable unit according to the first value is smaller than an amount of minimum adjustable unit according to the second value.

For example, in a case where the adjustable range of the feeding pitch or the needle swing width through the adjusting dial switch 16 is 0.0 mm to 7.0 mm, the minimum adjustable unit is 0.5 mm, and the number of adjustable stages through one complete rotation of the adjusting dial switch 16 is eight, there will be fifteen stages in the entire adjustable range.

Namely, if the first value is set to be 0.5 mm and is assigned to of the minimum adjustable unit (an adjusting amount per one stage), the adjusting dial switch 16 needs to be turned by about two complete rotations in a maximum case. On the other hand, the second value may be set to be 1.0 mm. In such a case, when the second value is assigned to the minimum adjustable unit, the adjusting dial switch 16 can cover the entire adjustable range through one complete rotation.

When the second value set such that the adjustable range can be covered by the number of stages within one complete rotation of the adjusting dial switch 16, it is advantageous in that the operator does not need to release and hold the adjusting dial switch 16 again.

The two assignable values, which are different from each other, are provided for each of the minimum adjustable units for the adjustment of the feeding pitch and the adjustment of the needle swing width respectively.

That is, in the exemplary embodiment, four different values are assignable to either one of the minimum adjustable units, namely, two different values (i.e. a set of first and second values) are assignable to the minimum adjustable units for the adjustment of the feeding pitch and other two different values (i.e., another set of first and second values) are assignable to the minimum adjustable units for the adjustment of the needle swing width.

Of course, depending of the design concept, the assignable values for the adjustment of the feeding pitch and the assignable values for the adjustment of the needle swing width may share one or more values to be assigned to the minimum adjustable units therefor, so that the total number of assignable values stored in the minimum adjustable unit setting part 21 may be two or three.

In the minimum adjustable unit setting part 21, moreover, a program and data for switching the two different assignable values are stored. More specifically, the program and the data are used to determine, after the power is turned on, whether a stitching operation is being carried out or not, i.e., whether the stitching motor 6 is in operation or not, and to assign the first value to the minimum adjustable unit if the stitching motor 6 is not in operation and to assign the second value to the minimum adjustable unit if the stitching motor 6 is in operation.

The switching of the two different values to be assigned to the minimum adjustable unit is actually executed by the CPU 17 based on he program and the data stored in the minimum adjustable unit setting part 21 of the storage portion 18.

The minimum adjustable unit setting part 21 also stores a program and data for controlling, when the adjusting dial switches 16 which are multistage switches including the feed adjusting means 14 and/or the swing width adjusting means 15 is operated, the needle swing width as to the needle swinging motor 7 and/or the feeding pitch as to the feeding motor 11 based on the number of operated stages and the first value or the second value assigned to the minimum adjustable unit.

In the storage portion 18, moreover, a program and data for processing various information necessary for executing sewing operations are stored. More specifically, such program and data are a sewing program and a sewing data (needle swing pattern data), based on which needle swing stitching patterns are formed on a cloth by feeding the cloth in a cloth feeding direction with a driving force of the feeding motor 11, moving the needle 5 in the vertical directions with a driving force of the stitching motor 6, and swinging the needle 5 in a swing width direction, which is orthogonal to the cloth feeding direction, with a driving force of the needle swinging motor 7.

Of course, when the needle swing width or the feeding pitch is adjusted, the adjusted width set by the minimum adjustable unit setting part 21 is reflected in the sewing operations thereafter.

For example, in a case where the first value is set to be 0.5 mm and the second value is set to be 1.0 mm, when the adjusting dial switch 16 is operated by one stage while the first value is assigned to the minimum adjustable unit by the minimum adjustable unit setting part 21, sewing operations are executed with the needle swing width or the feeding pitch that is 0.5 mm increased from the initial value, and when the adjusting dial switch 16 is operated by one stage while the second value is assigned to the minimum adjustable unit by the minimum adjustable unit setting part 21, sewing operations are executed with the needle swing width or the feeding pitch that is 1.0 mm increased from the initial value.

In the storage portion 18, a program, data, an operating system and device drivers, etc., are also stored for executing initializing operations when the power supply is turned on.

Other configurations of the exemplary embodiment are similar to those of related art zigzag sewing machines, and thus, detailed description thereof will be omitted.

Next, operations in the zigzag sewing machine 1 of the exemplary embodiment which is configured as described above will be explained with reference to FIG. 3.

Because a control relating to basic sewing operations are similar to the related art, only an operation for adjusting the feeding pitch or the needle swing width will be described below.

Figure 3:
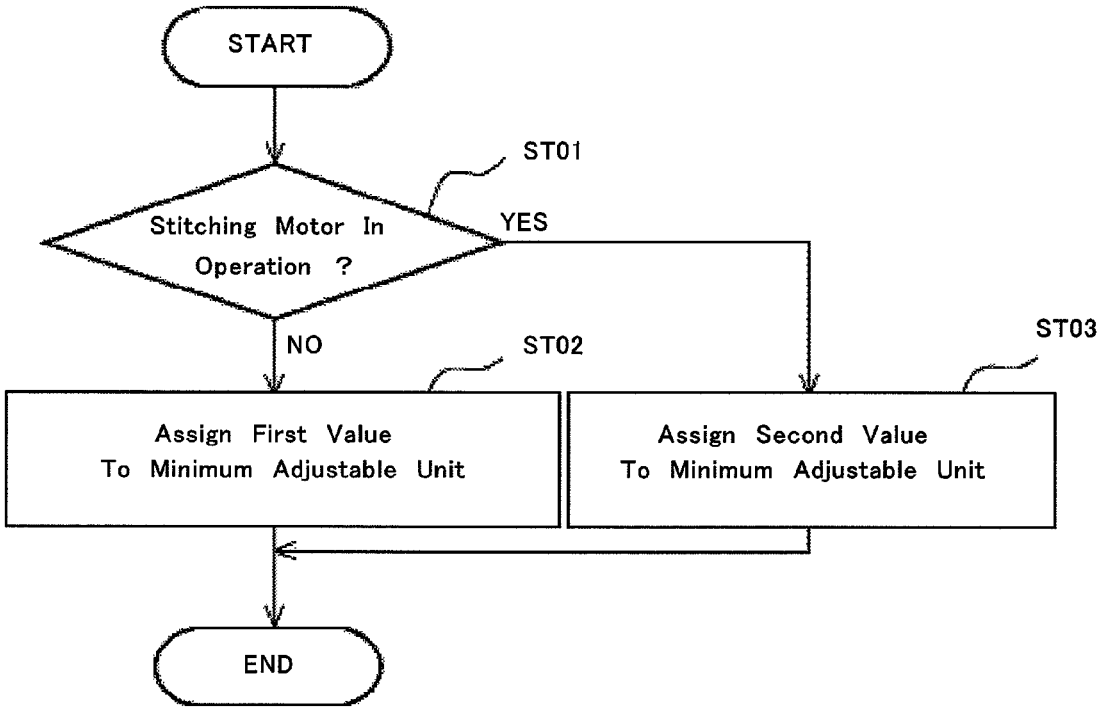
FIG. 3 is a flowchart of an adjusting operation in the zigzag sewing machine.

As shown in FIG. 3, the operation for adjusting the feeding pitch or the needle swing width in the zigzag sewing machine 1 of the exemplary embodiment is started when the operator turns the adjusting dial switch 16. After turning on the power, the control section 13 determines whether the stitching motor 6 is in operation or not (Step 01). Such a determination as to whether the stitching motor 6 is in operation or not may be based on, for example, whether the start switch 19 is operated or not, or a detection signal from a sensor, e.g., a rotary encoder, which detects a rotation of the spindle.

If the determination result in Step 01 is "NO" (i.e., if the stitching motor 6 is not in operation), the first value, which is smaller than the second value, is assigned to the minimum adjustable unit (Step 02). In detail, the first value is read from the minimum adjustable unit setting part 21 and is written into a work area (RAM) of the storage portion 18.

If the determination result in Step 01 is "YES" (if the stitching motor 6 is in operation), the second value, which is greater than the first value, is assigned to the minimum adjustable unit (Step 03). In detail, the second value is read from the minimum adjustable unit setting part 21 and is written into a work area (RAM) of the storage portion 18.

Accordingly, when the stitching motor 6 is not in operation (i.e., when a stitching is nor being carried out), the minimum adjustable unit in the turning operation of the adjusting dial switch 16 is set the first value according to which an adjustment is carried out in small units, and when the stitching motor 6 is in operation (i.e., during the stitching), the minimum adjustable unit in the turning operation of the adjusting dial switch 16 is set to the second value whereby the adjustment can be carried out in larger units.

For example, as described above, in a case where the adjustable range through the adjusting dial switch 16 is set to be 0.0 mm to 7.0 mm, the minimum adjustable unit is set to be 0.5 mm, and the number of adjustment stages through one complete rotation of the adjusting dial switch 16 is set to be eight, the total number of adjustment stages becomes fifteen to cover the entire adjustable range.

Namely, if the first value is set to be 0.5 mm and is assigned to of the minimum adjustable unit (an adjusting amount per one stage), the adjusting dial switch 16 needs to be turned by about two complete rotations in a maximum case. On the other hand, the second value may be set to be 1.0 mm. In such a case, when the second value is assigned to the minimum adjustable unit, the adjusting dial switch 16 can cover the entire adjustable range through one complete rotation.

Therefore, when the second value set such that the entire adjustable range can be covered by the number of stages within one complete rotation of the adjusting dial switch 16, there is no need to release and hold the adjusting dial switch 16 again.

In a case where a push button switch is used as the multistage switch, the number of pushing operations on the push button switch to adjust a certain amount of the feeding pitch or the needle swing width may be set such that the number of pushing operations with the first value being assigned to the minimum adjustable unit is half of the number of pushing operations with the second value being assigned to the minimum adjustable unit The selection between the two values to be assigned to the minimum adjustable unit, i.e., the switching operation, may be executed during a rotational operation of the adjusting dial switch 16 from a position of the stage before the operation to a position of the adjacent stage in the operating direction.

Alternatively, the switching operation between the two values to be assigned to the minimum adjustable unit may be executed before the turning operation of the adjusting dial switch 16, depending on whether the stitching motor is in operation or not.

More specifically, in such a case, the first value is read and written into the work area (RAM) of the storage portion 18, after the initializing operations that are executed in response to the turning on of the power switch 20. When the start switch 19 is turned on subsequently so that the stitching motor 6 is driven, the first value written in the work area (RAM) of the storage portion 18 is replaced with the second value, and when the stitching motor 6 is stopped thereafter, the second value written in the work area (RAM) of the storage portion 18 is replaced with the first value.

According to the zigzag sewing machine 1 of the exemplary embodiment, when the stitching motor 6 is not in operation, i.e., not during the stitching operation, the feeding pitch or the needle swing width is adjusted with the first value assigned to the minimum adjustable unit, while allowing the operator to release and hold the adjusting dial switch 16 without any trouble. Therefore, the operator can reliably carry out fine adjustment of the feeding pitch or the needle swing width while also confirming the positional relationship between the needle and the cloth.

When the stitching motor 6 is in operation, i.e., during the stitching operation, on the other hand, the feeding pitch or the needle swing width is adjusted with the second value assigned to the minimum adjustable unit. Therefore, the entire adjustable range is covered within one complete rotational operation of the adjusting dial switch 16, thereby allowing the operator to reliably adjust the feeding pitch or the needle swing width while confirming the positional relationship between the needle and the cloth without taking the eyes off the cloth to look at the adjusting dial switch 16.

That is, the zigzag sewing machine 1 of the exemplary embodiment is configured to switch the two different values (i.e., the first value and the second value which is greater than the first value) to be assigned to the minimum adjustable value, depending on whether the stitching motor 6 is in operation or not. Therefore, the operability when adjusting the feeding pitch or the needle swing width is reliably improved. As a result, it is possible to improve usability of the zigzag sewing machine.

According to the zigzag sewing machine 1 of the exemplary embodiment, moreover, the multistage switch is the adjusting dial switch 16 which is rotatably operable or the push button. Therefore, it is possible to suppress cost increase.

According to the zigzag sewing machine 1 of the exemplary embodiment, moreover, it is possible to adjust the feeding pitch or the needle swing width while switching the two values to be assigned to the minimum adjustable unit in an existing zigzag sewing machine having a multistage switch for adjusting the feeding pitch or the needle swing width by installing a software without replacing the components thereof, thereby improving adjusting operability of the feeding pitch or the needle swing width.

The feeding mechanism may have such a configuration as disclosed in JP 10-146480 A, in which the feed dog is directly driven to feed a cloth by a driving force from the feeding motor. Also in such a case, the cloth feeding amount is determined by the feeding motor 11.

While description has been made in connection with an exemplary embodiment of the present invention, those skilled in the art will understand that various changes and modification may be made therein without departing from the present invention. It is aimed, therefore, to cover in the appended claims all such changes and modifications falling within the true spirit and scope of the present invention.

What is claimed is:

1. A zigzag sewing machine comprising:

a needle;

a stitching motor which moves the needle in a vertical direction;

a feed dog disposed below the needle;

a feeding motor which moves the feed dog to feed a cloth in a cloth feeding direction;

a needle swinging motor which swings the needle in a direction intersecting the vertical direction and the cloth feeding direction;

a multistage-operating portion operable to adjust at least one of a feed amount of the cloth and a swing amount of the needle in a minimum adjustable unit; and a control section which controls the stitching motor, the feeding motor and the needle swinging motor to carry out a zigzag sewing in accordance with the at least one of the feed amount and the swing amount adjusted by the multistage-operating portion, wherein the control section is configured to assign a first value to the minimum adjustable unit when the stitching motor is not in operation and to assign a second value, which is different from the first value, to the minimum adjustable unit when the stitching motor is in operation.

2. The zigzag sewing machine according to claim 1, wherein the first value is smaller than the second value.

3. The zigzag sewing machine according to claim 1, wherein the multistage-operating portion comprises a dial which is rotatably operable to adjust the at least one of the feed amount and the swing amount, and the second value is set such that an adjustable range of the at least one of the feed amount and the swing amount is covered within one complete rotation of the dial.

4. The zigzag sewing machine according to claim 2, wherein the multistage-operating portion comprises a dial which is rotatably operable to adjust the at least one of the feed amount and the swing amount, and the second value is set such that an adjustable range of the at least one of the feed amount and the swing amount is covered within one complete rotation of the dial.

5. The zigzag sewing machine according to claim 1, wherein the multistage-operating portion comprises a push button.

6. The zigzag sewing machine according to claim 1, wherein the control section comprises a storage portion in which the first value and the second value are stored.

7. The zigzag sewing machine according to claim 1, further comprising:

a bed portion inside which the feed dog is disposed;

a coupling body portion upwardly extending from one end of the bed portion; and an arm portion extending from an upper end of the coupling body portion in parallel to the bed portion;

wherein the needle is disposed below a free end portion of the arm portion, and the multistage-operating portion is disposed on a surface of the coupling body portion.

8. The zigzag sewing machine according to claim 7, further comprising a display screen arranged on the surface of the coupling body portion on which the multistage-operating portion is disposed.

9. The zigzag sewing machine according to claim 8, wherein the display screen is arranged above the multistage-operating portion and is configured to display the at least one of the feed amount and the swing amount adjusted by the multistage-operating portion.

* * * * *